US005401095A

United States Patent [19]

Williams et al.

[11] Patent Number: 5,401,095

[45] Date of Patent: Mar. 28, 1995

[54] SPACE MASTER CABINET SYSTEM

[76] Inventors: Kenneth J. Williams, Harold Rte., Box 608, Sutton, W. Va. 26601; Hans D. Horn, Postfach 140, D-7062 Rudersberg, Germany

[21] Appl. No.: 184,353

[22] Filed: Jan. 21, 1994

Related U.S. Application Data

[63] Continuation of Ser. No. 857,218, Mar. 25, 1992, abandoned, which is a continuation-in-part of Ser. No. 749,281, Aug. 23, 1991, abandoned.

[51] Int. Cl.[6] ..... A47B 91/00

[52] U.S. Cl. ..... 312/249.9; 312/314; 312/307

[58] Field of Search ..... 312/307, 312, 313, 203, 312/317.3, 249.9; 108/40

[56] References Cited

U.S. PATENT DOCUMENTS 170,369 11/1875 Heyl ..... 108/67
688,834 10/1928 Sharf ..... 312/307
1,705,151 3/1929 Card ..... 312/307
4,910,916 3/1990 Dubach ..... 312/337

*Primary Examiner*—Peter R. Brown
*Assistant Examiner*—Gerald A. Anderson
*Attorney, Agent, or Firm*—Reed Smith Shaw & McClay

[57] ABSTRACT

Furniture including a pop up table feature, wherein a glide track and interlocking pin and detent structure in opposing interior panels of a base cabinet are used to permit the table and mobile cart portions of the furniture to be easily disassembled from the stationary base cabinet of the device. Other embodiments of the present invention may include an upper and/or lower set(s) of alignment/locking blocks that mobile cart portions of the device to be securely closed and positioned into the stationary base cabinet. Other embodiments of the present invention include the use of set of spring-biased or locking guide pins attached to the table, guide pin exit ports as well as other means to permit the unit to be readily disassembled, while providing stable yet collapsible storage and work areas.

11 Claims, 10 Drawing Sheets

SPACE MASTER CABINET SYSTEM

CROSS-REFERENCES TO RELATED APPLICATIONS

This is a continuation of application Ser. No. 07/857,218, filed on Mar. 25, 1992, now abandoned, which is a continuation-in-part of U.S. patent application Ser. No. 07/749,281, filed Aug. 23, 1991, and now abandoned, entitled "SPACE MASTER CABINET SYSTEM."

FIELD OF THE INVENTION

The present invention relates to improvements in collapsible cabinet and table systems having a stationary base cabinet, a table top, capable of being stored in a substantially vertical position and used in a substantially horizontal position, and a mobile cart which simultaneously operates the table top and is stored inside of or pulled from the base cabinet.

BACKGROUND OF INVENTION

Modern conveniences require consolidation of furniture. The invention set forth hereinafter provides collapsible, compact and Convenient furniture useful in such matters as sewing machine cabinets, and home and office business facilities that include computers and other equipment, as well as in a variety of other applications.

Other folding table/storage cabinet devices are known, but each fail to solve certain limitations and disadvantages as are solved with the present invention. U.S. Pat. No. 2,004,896 discloses a foldaway table system, but without the significant improvements provided for in the present invention, and as described below. German Patent Application No. DE 3,739,658 A1 discloses a foldaway table top, but without the stabilizing and adaptability features of the present invention. Likewise, German Patent Application No. 2,013,607 discloses a folding table that lacks important features of and functions unlike the present invention.

SUMMARY OF INVENTION

The present invention relates to improvements in collapsible or foldaway work surfaces, mobile and fixed storage cabinets.

The present invention provides a desirable solution to problems associated with such compact, foldaway work systems by improving the stability, flexibility, compactness, ease of assembly and disassembly, and other desirable features that offer advantages over known systems. The present invention offers an improved device capable of meeting a broad range of functional needs, yet, that can be collapsed so as to meet important space requirements and limitations. The present invention provides a convenient, economic and expedient manner in which such items as hobby equipment and home and business off ice facilities and equipment may be stored in a space conserving environment. The present invention is adaptable four use with such applications as (including, but not limited to) computers and peripherals, sewing machines, and many other items. The invention permits equipment and work surfaces/areas to be quickly expanded and/or raised to an elevated position to provide ready operator access, later to be conveniently returned to a condensed storage position.

Embodiments of the present invention provide a glide track and interlocking pin and detent/slot structure in opposing interior panel of a base cabinet, optionally provided with a system of entrance/exit channels which permit the table/mobile Cart portions of the device to be easily disassembled from the stationary base cabinet of the device.

Other embodiments of the present invention may include an upper and/or lower set(s) of alignment/locking blocks that mobile cart portions of the device to be securely closed and positioned into the stationary portion of the device.

Another embodiment of the present invention includes a set of spring-biased or locking guide pins attached to the table (and thereby to the mobile cart portion(s) of the device) to be easily disassembled from the base cabinet portion of the unit, exchanged for another attachable mobile cart portion, and/or used independently from the stationary base cabinet portion of the device.

DESCRIPTION OF DRAWINGS

In the accompanying drawings, preferred embodiments of the invention are illustrated by way of example only, wherein.

DESCRIPTION OF THE PREFERRED EMBODIMENTS

The height, width and depth of the base cabinet/-work surface/mobile cart unit can be varied to meet desired criteria; a desirable set of dimensions (in inches) and associated applications for the device are set forth in TABLE I.

TABLE I

| Application | Height | Widths | Depth |
|---|---|---|---|
| Standard Desk | 28¾ | 21, 24, 27, 30 | 21 |
| Bath/Vanity | 30 11/16 | 21, 24, 27, 30 | 21 |
| Kitchen | 34½ | 21, 24, 27, 30 | 24 |
| Sewing Cabinet | 28¾ | 21, 24, 27, 30 | 21 |

The collapsible cabinet and table system of the present invention allows easy removal and installation of mobile cabinet/caddie to provide easy transportation and moving of the cabinet. The space saving pullout is a unique system that offers space saving and function in one cabinet. When the mobile cabinet is pulled out of the base cabinet, the table (work surface) pops up automatically and locks in the up position; in some embodiments, the pins drops in track indents. To store or collapse the unit, the user applies lift to the table/work surface, and then pushes the work surface/mobile cabinet into the base cabinet. To open the unit, the user pulls out the mobile unit, which simultaneously lifts the table/work surface into the horizontal or "up" position.

Casters, slides, wheels or other means may be used under the mobile cabinet to facilitate the movement and operation of the device. The resulting unit is quite flexible, light, occupies little space when folded, and provides a stable work area when in operating position.

Figure 2:
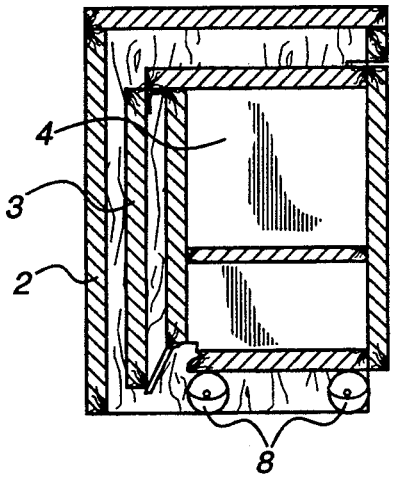
FIG. 2 shows a side view of a collapsed unit of the present invention.
Figure 1:
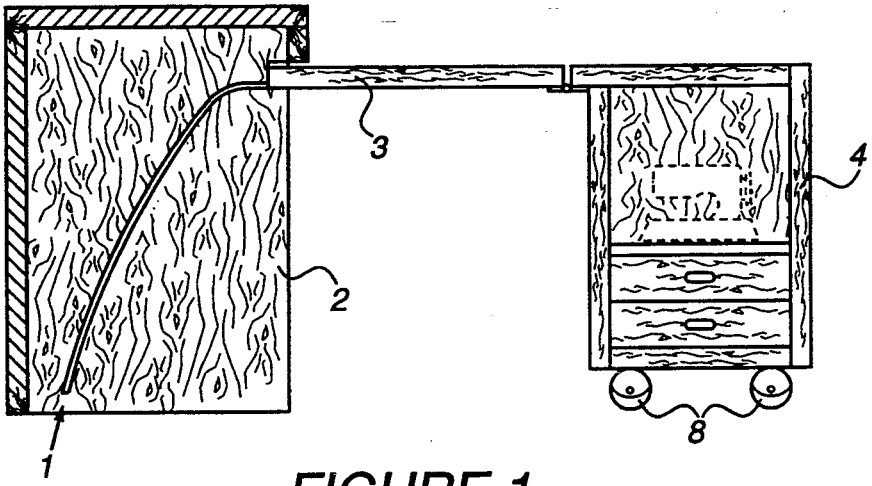
FIG. 1 shows a side view of the extended unit of the present invention.

FIG. 1 shows a side elevational view, in partial section, of one embodiment of the invention. This embodiment of unit 1 shows a base cabinet 2, which operates as a "nesting" or "docking" station or garage for and mobile cart 4. A hinged, movable work surface 3 spans the distance between the base cabinet 2 and mobile cart 4. Mobile unit 4 is capable of sliding or rolling on casters 8 into the internal cavity of base cabinet 2, as shown in FIG. 1 and cutaway FIG. 2.

Figure 3:
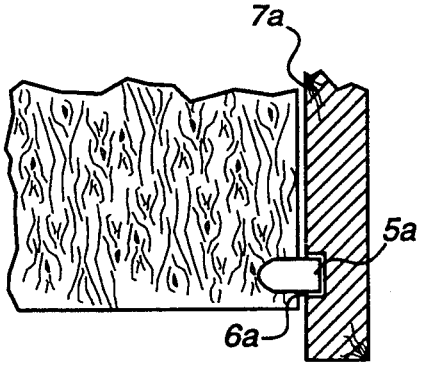
FIG. 3 shows an end view of a pin and slide track embodiment of the present invention.

FIG. 3 shows a pin 5*a* which nests in track 6*a* of an inner wall 7*a* of base cabinet 2. As shown in FIG. 3, pin 5*a* glides along track 6*a*. Track 6*a* is cut in inner wall 7*a* of base cabinet 2.

Figure 4:
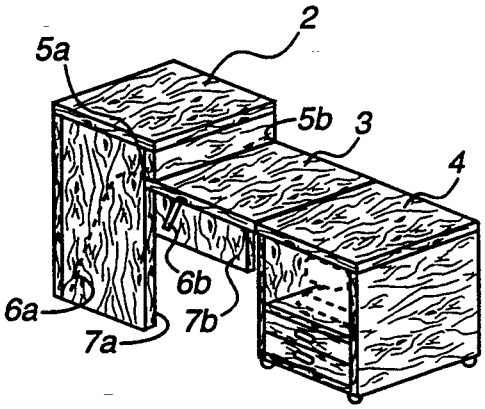
FIG. 4 shows a perspective view of an extended unit the present invention.

FIG. 4 shows a perspective view of mobile cart 4 extended in use position from base cabinet 2. FIG. 4 also shows the inner wall 7*b* with track 6*b*; pin 5*b* slides along track 6*b*. As shown in FIG. 4, inner wall 7*b*, with track 6*b* and pin 5*b* is a mirror image of pin 5*a*, track 6*a* and inner panel 7*a* depicted in FIG. 3.

As shown in FIG. 4, pins 5*a* and 5*b* slide along tracks 6*a* and 6*b*, respectively, so as to permit work surface 3 to be folded down and moved inside base cabinet 2, as mobile unit 4 is simultaneously rolled inside base cabinet 2 on casters 8. Work surface 3/mobile cart 4 can easily be detached from base cabinet 2 once pins 5*a* and 5*b* are freed from their position in tracks 6*a* and 6*b*.

Figure 5:
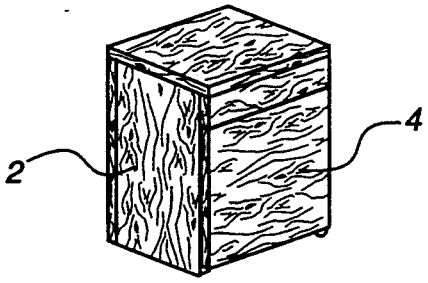
FIG. 5 shows a perspective view of a collapsed unit of the present invention.

FIG. 5 shows a perspective view of base cabinet 2, with mobile cart 4 stored completely inside.

Figure 6A:
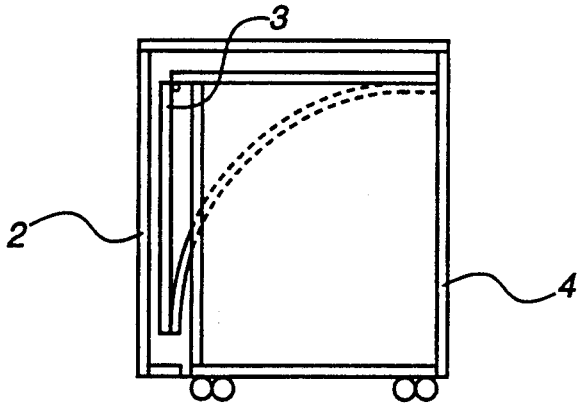
FIG. 6A shows a side view of a pin and slide track embodiment of the present invention.
Figure 6B:
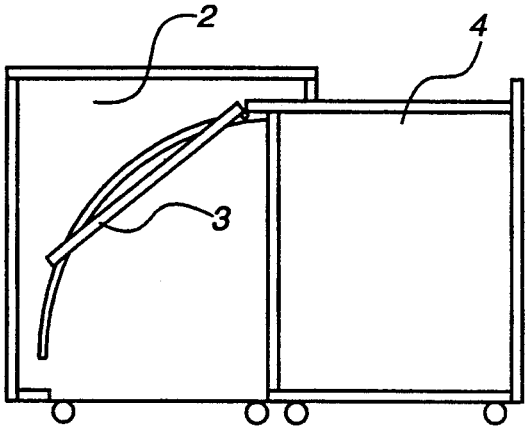
FIG. 6B show a side view of a pin and slide track embodiment of the present invention.
Figure 6C:
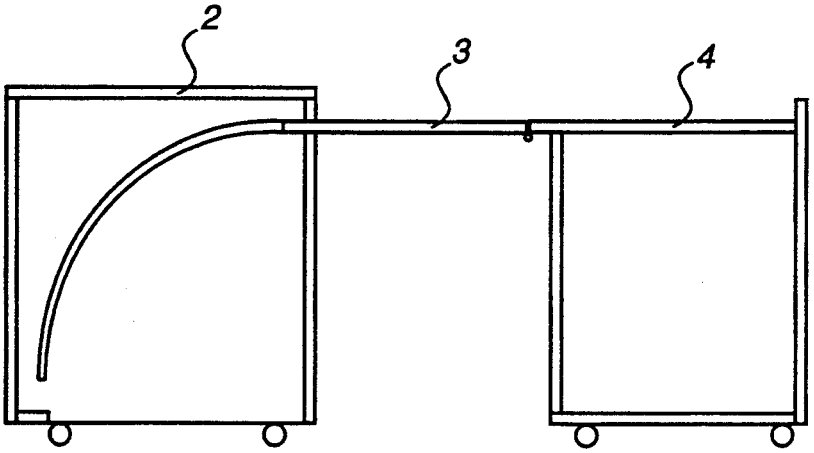
FIG. 6C shows a side view of a pin and slide track embodiment of the present invention.

FIG. 6A shows a side view of work surface 3 fully collapsed inside base cabinet 2, and mobile unit 4 rolled fully inside base cabinet 2. FIG. 6B shows a side view of work surface 3 partially collapsed inside base cabinet 2, and mobile unit 4 partially rolled out of base cabinet 2. FIG. 6C shows a side view of work surface 3 fully extended into horizontal use position outside inside base cabinet 2, and mobile unit 4 fully extended from base cabinet 2.

Figure 7:
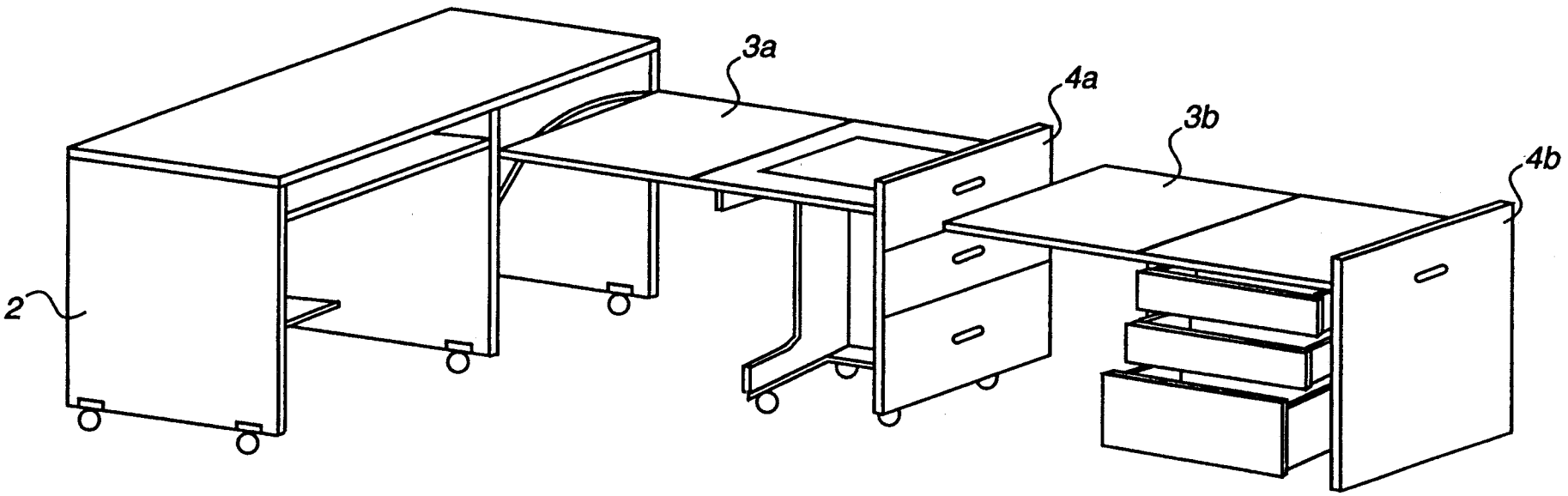
FIG. 7 shows a multi-use embodiment of the present invention.

FIG. 7 shows a perspective view of a base cabinet 2, with interchangeable mobile cart/work surface units. A first mobile cart 3*a* and work surface 4*a* unit may be intended for use as a home sewing setup; a second mobile cart 3*b* and work Surface 4*b* unit may be intended for use as a home office setup.

Figure 8D:
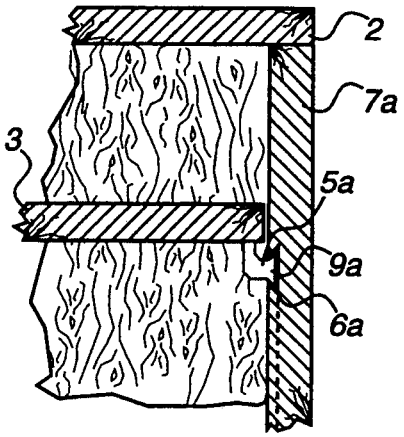
FIG. 8D shows an end view of an embodiment of the present invention.
Figure 8C:
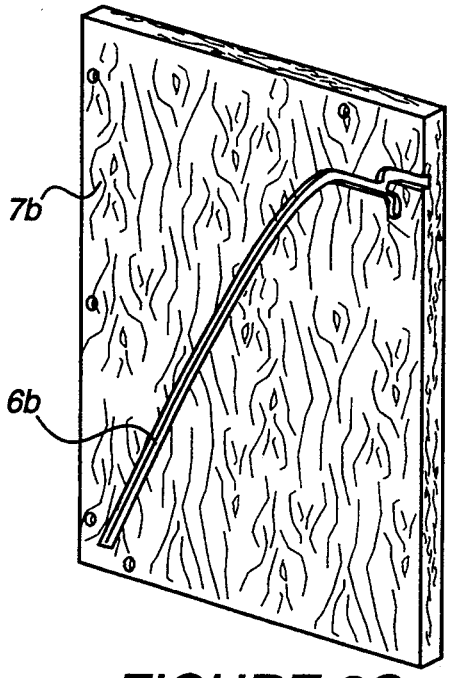
FIG. 8C shows a perspective view of an embodiment of the present invention.
Figure 8B:
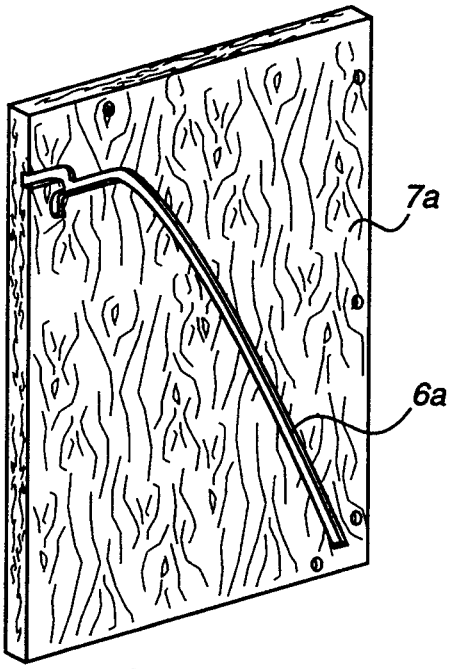
FIG. 8B shows a perspective view of an embodiment of the present invention.
Figure 8A:
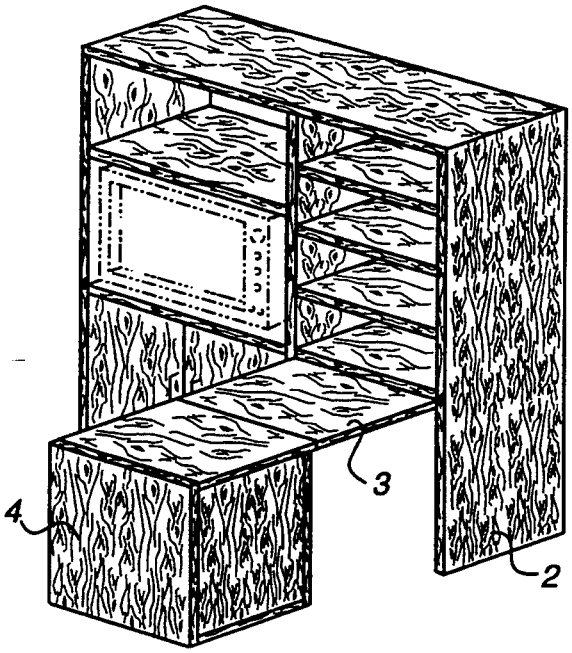
FIG. 8A shows a perspective view of an embodiment of the present invention.

FIG. 8A shows a perspective view of another embodiment of base cabinet 2, with a mobile cart 4 and work surface 3. FIG. 8B shows a perspective view of inner panel 7*a* of base cabinet 2, with track 6*a* cut into inner panel 7*a*. FIG. 8C shows a perspective view of inner panel 7*b* of base cabinet 2, with track 6*b* cut into inner panel 7*b*.

FIG. 8D shows an end view of a desired embodiment of pin 2*a* and track 6*a*. Flared base 9*a* prevents the outer end of pin 2*a* from slipping out of conforming track 6*a* of inner panel 7*a* adapted to substantially matingly receive flared base 9*a*. This interlocking system of pin 2*a*, flared base 9*a* and track 6*a* adds stability and security to the unit. An optional embodiment of pin 2*a* is detachably fastened to flared base 9*a*, so that this interlocking pin and track system may be used with closed end embodiments of tracks 6*a* and 6*b* of the present invention, as described and shown in the Figures below. A mirror image of flared base 8*a*, pin 2*a* and track 6*a* of inner panel 7*a* (flared base 8*b*, pin 2*b* and track 6*b*) are also opposingly configured with inner side 7*b* (not shown).

Figure 10:
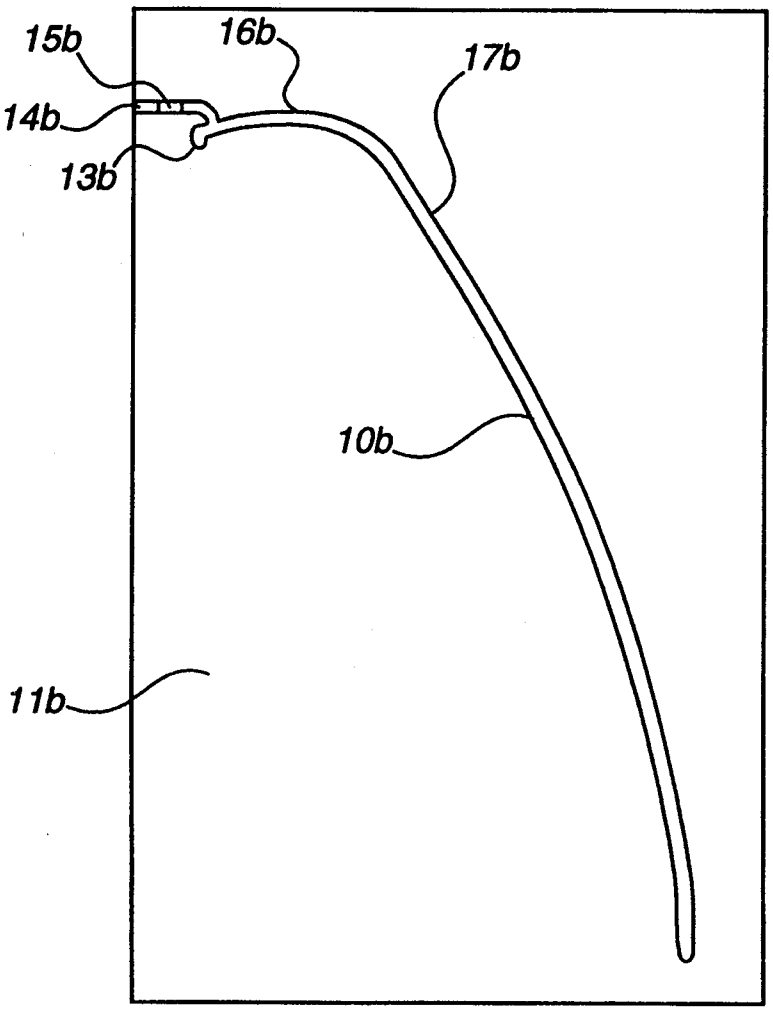
FIG. 10 shows a side view of an embodiment of the present invention.
Figure 9:
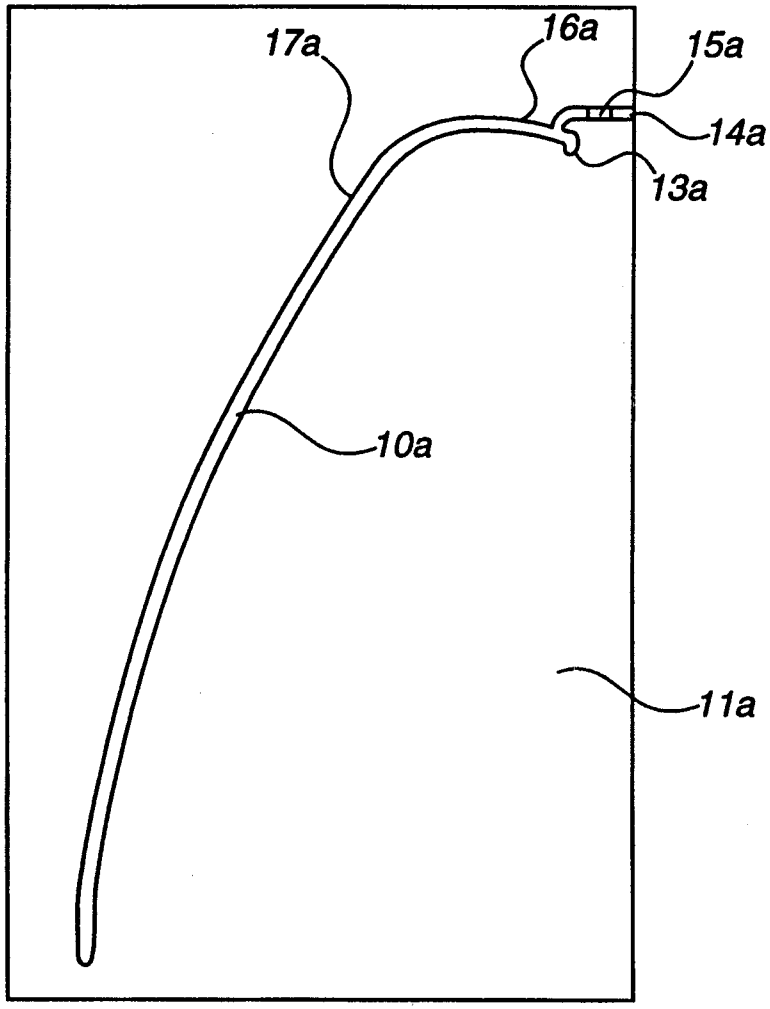
FIG. 9 shows a side view of an embodiment of the present invention.

FIG. 9 shows a detailed side view of a preferred configuration of the inner wall of the base cabinet 2 (as shown in FIG. 8A, for example), which inner wall is herein designated by reference numeral 11*a*. Also shown is a preferred track embodiment designated by reference numeral 10*a*. FIG. 10 shows a detailed side view of the configuration of an opposing inner wall configuration that is a mirror image of FIG. 9. On this opposing inner wall, designated by reference numeral 11*b*, a pin will slide along a track 10*b*. For purposes of explanation, FIG. 9 will be used to describe the inner wall, pin and track configurations of this embodiment of device 1, as again, each set of inner walls, pins and tracks are a mirror image of each other.

FIG. 9 shows the upper portion of track 10*a* having a lower detent 13*a* and a top exit port 14*a*. In some desired embodiments, a stop block 15*a* may be permanently or removably placed inside top exit port 14*a*, to prevent/permit a pin to exit track 10*a*, and as shown in FIG. 7, to permit work surface 3 and mobile cart 4 to be completely detached from base cabinet 2. Stop block 15*a* is not necessary in all applications. Desirably, portion 16*a* of track 10*a* may have a slight downward slope in relation to portion 17*a* of the track. In this manner, the weight of work surface 3 assists in stabilizing mobile cart 4 and work surface 3 while in its fully extended position, as shown in FIGS. 1, 4 and 6C.

FIG. 10 is a mirror image of FIG. 9. FIG. 10 shows the upper portion of track 10*b* having a lower detent 13*b* and a top exit port 14*b*. In some desired embodiments, a stop block 15*b* may be permanently or removably placed inside top exit port 14*b*, to prevent/permit a pin to exit track 10*b*, and as shown in FIG. 7, to permit work surface 3 and mobile cart 4 to be completely detached from base cabinet 2. Stop block 15*b* is not necessary in all applications. Desirably, portion 16*b* of track 10*b* may have a slight downward slope in relation to portion 17*b* of the track. Again, in this manner, the weight of work surface 3 assists in stabilizing mobile cart 4 and work surface 3 while in its fully extended position, as shown in FIGS. 1, 4 and 6C.

Figure 11B:
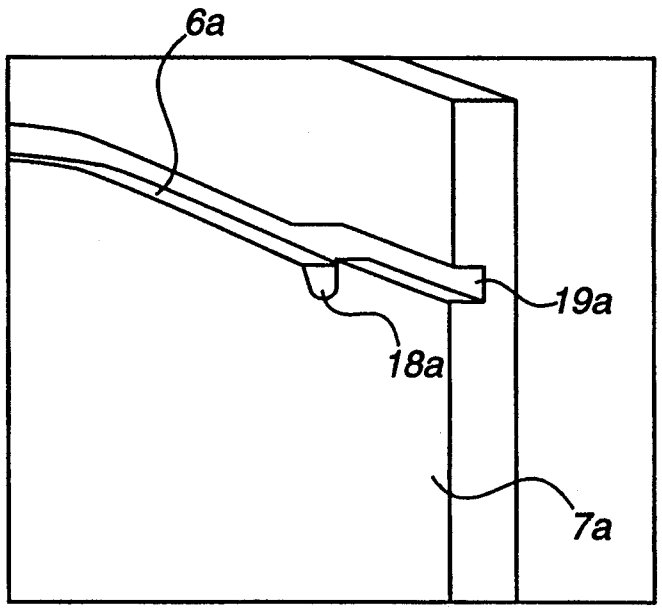
FIG. 11B shows a perspective view of a pin and slide track embodiment of the present invention.
Figure 11A:
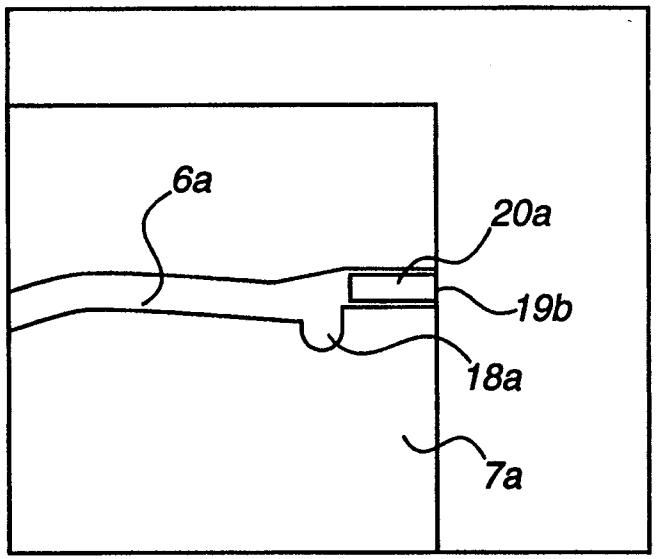
FIG. 11A shows a side view of a pin and slide track embodiment of the present invention.

FIGS. 11A and 11B show another embodiment of inner wall 7*a* track 6*a*, having a small lower stop detent 18*a* and a top exit port 19*b*. In some desired embodiments, a stop block 20*a* (as shown in FIG. 11*a*) may be permanently or removably placed inside top exit port 19*a*, to prevent/permit a pin to exit the end of track 6. The opposing inner wall and track (not shown) is a mirror image of FIGS. 11A and 11B.

The configuration of track 6*a* near the exit port in FIGS. 11A and 11B permits the user to move the table or work surface to which pin 5 is mounted easily out of the track, or deeper into the track. As such, track 6*a* as shown in FIGS. 11A and 11B may be preferable over the track 6*a* shown in FIGS. 9 and 10.

Figure 12B:
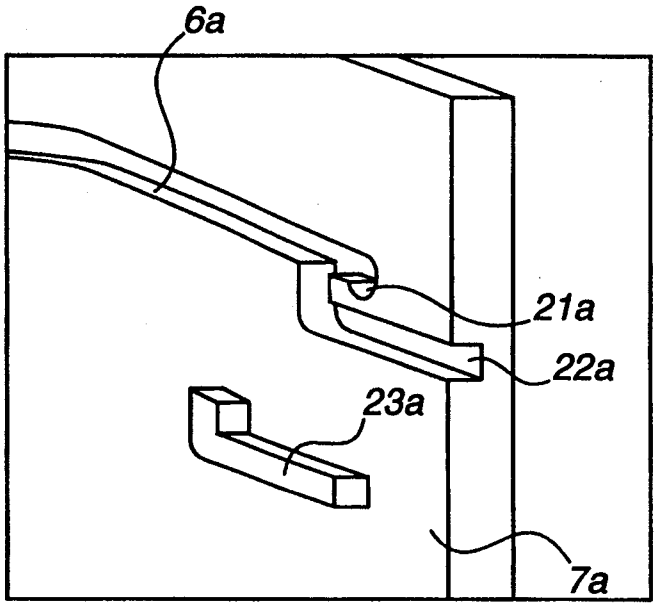
FIG. 12B shows a perspective view of a pin and slide track embodiment of the present invention.
Figure 12A:
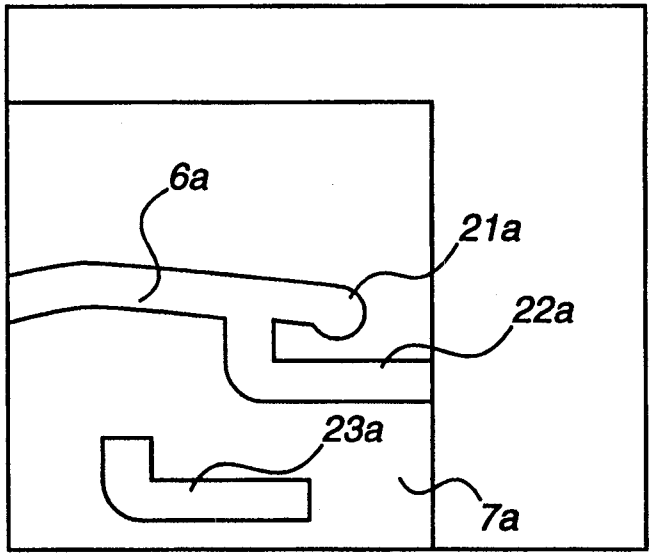
FIG. 12A shows a side view of a pin and slide track embodiment of the present invention.

FIGS. 12A and 12B show another embodiment of inner wall 7*a* with track 6*a*, having a stop detent 21*a*, and a bottom exit port 22*a*. An L-shaped stop block 23*a* is permanently or removably placed inside bottom exit port 22*a*, to prevent/permit pin 5 to exit track 6*a*. The opposing inner wall and track (not shown) is a mirror image of FIGS. 12A and 12B.

Figure 13B:
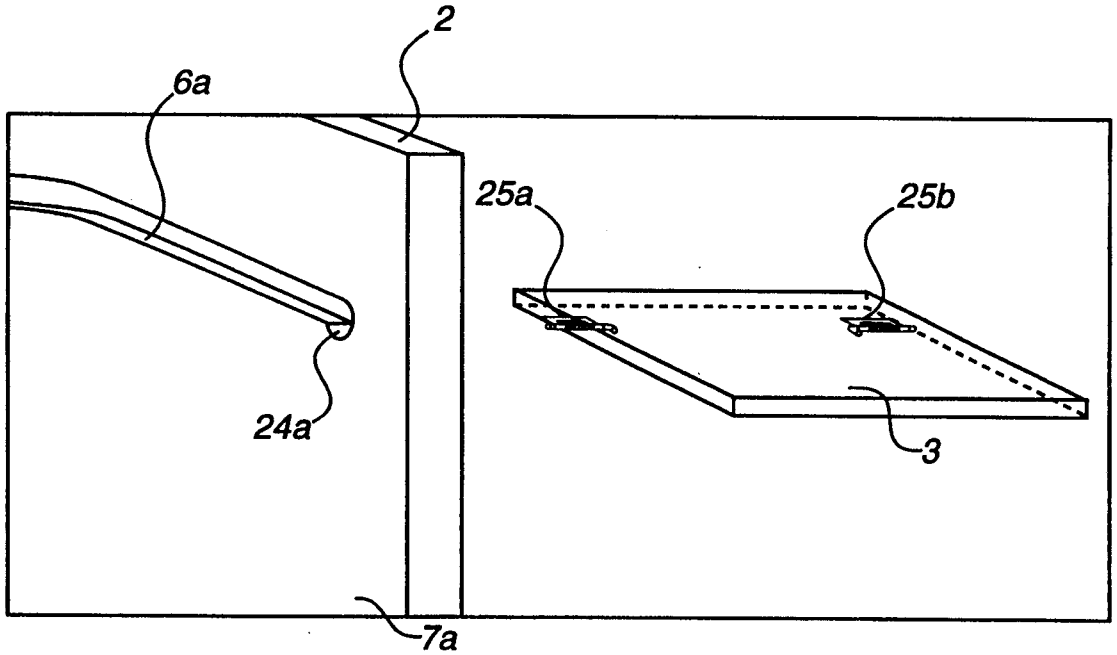
FIG. 13B shows an exploded perspective view of a pin and slide track embodiment of the present invention.
Figure 13A:
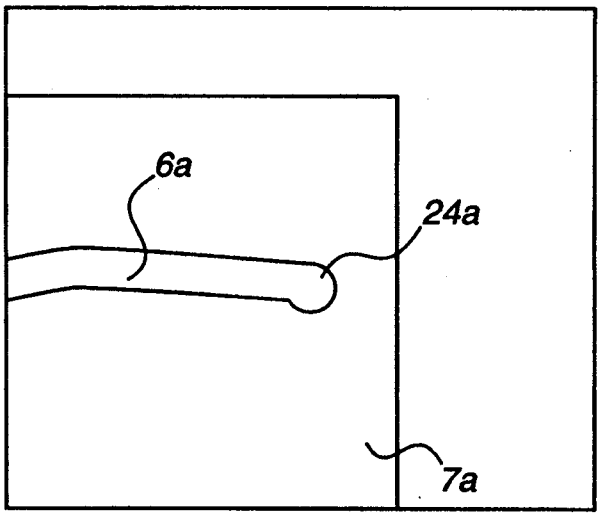
FIG. 13A shows a side view of a pin and slide track embodiment of the present invention.

FIGS. 13A and 13B show another embodiment of inner wall 7*a* with track 6*a*, having a stop detent 24*a*, but not requiring any exit port. Retractable pins 25*a* and 25*b* prevent/permit work surface 3 to be attached or detached from base cabinet 2. The opposing inner wall and track (not shown) is a mirror image of FIGS. 13A and 13B.

Figure 14B:
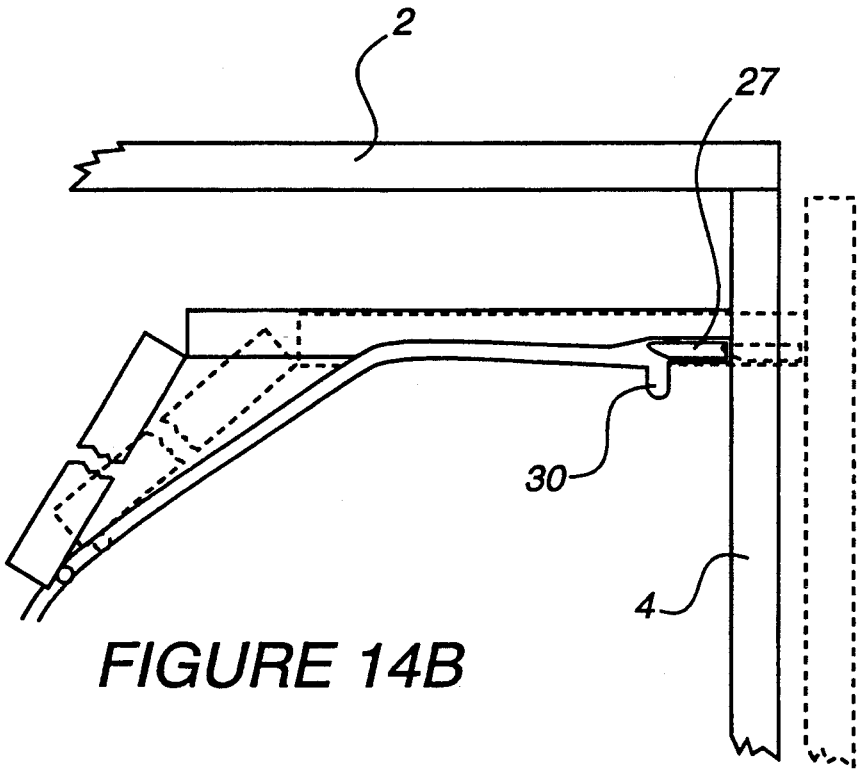
FIG. 14B shows a side view of a pin and slide track embodiment of the present invention.
Figure 14A:
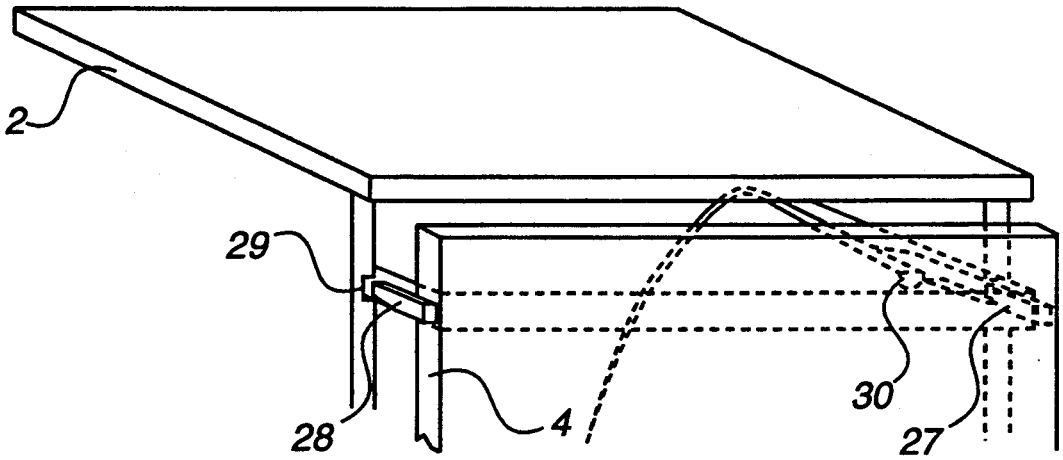
FIG. 14A shows a perspective view of a pin and slide track embodiment of the present invention.

FIGS. 14A and 14B show an embodiment of the device that includes upper guide blocks 27 and 28, mounted on the sides of mobile cart 4, which insert into tracks 29 and 30 so as to align and/or secure mobile cart 4 into nesting or storage position inside base cabinet 2. In alternative embodiments as apparent in FIGS. 14A, 14B, and other Figures herein, the slots may be formed in the mobile cart and the guide blocks may be attached to the inner sides of the base cabinet.

Figure 15C:
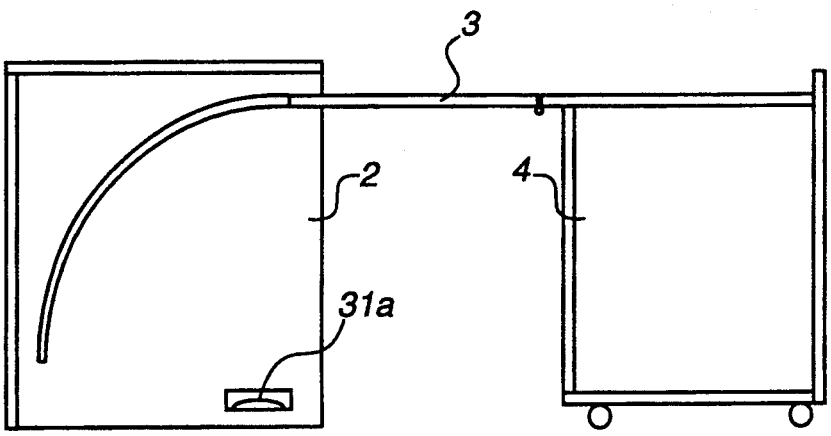
FIG. 15C shows a side view of a pin and slide track embodiment of the present invention.
Figure 15B:
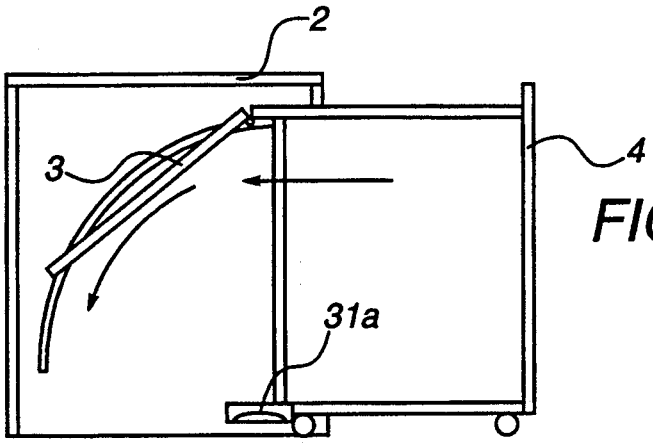
FIG. 15B shows a side view of a pin and slide track embodiment of the present invention.
Figure 15A:
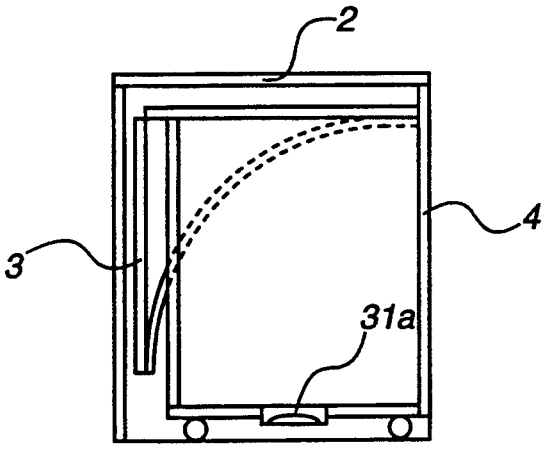
FIG. 15A shows a side view of a pin and slide track embodiment of the present invention.

FIGS. 15A, 15B and 15C show three side views of an embodiment of the device that includes lower guide block 31*a*, mounted on the inside surfaces of base cabinet 2, so as to elevate and/or align and/or secure mobile cart 4 into nesting or storage position inside base cabinet 2. The opposing inner wall, track and guide block is a mirror image of that shown in FIGS. 15A, 15B and 15C.

FIG. 15A shows a side view of work surface 3 fully collapsed inside base cabinet 2, and mobile unit 4 rolled fully inside base cabinet 2, with the lower corners of mobile cart 4 resting on lower guide block 31*a* (and as the reader will appreciate, the mobile cart 4 will simultaneously rest on the opposing lower guide block on the opposite inner wall, not shown), so as to elevate and/or align and/or secure mobile cart 4 into nesting or storage position inside base cabinet 2. FIG. 15B shows a side view of work surface 3 partially collapsed inside base cabinet 2, mobile unit 4 partially rolled out of base cabinet 2, with the lower leading corners of mobile cart 4 just touching the leading edge of lower guide block 31*a*, and its opposing lower guide block, not shown). FIG. 15C shows a side view of work surface 3 fully extended into horizontal use position outside inside base cabinet 2, and mobile unit 4 fully extended from base cabinet 2.

While presently preferred embodiments of practicing the invention i has been shown and described with particularity in connection with the accompanying drawings, the invention may be otherwise embodied within the scope of the following claims.

What is claimed is:

1. A collapsible cabinet and table system including a base cabinet having an internal cavity and a mobile cart having a table top, said system comprising:

at least one retaining pin connected to a leading edge of said table top;

at least one curved track provided in said cavity, said at least one curved track being cooperable with said at least one retaining pin to direct said table top to a substantially vertical storage position within said base cabinet and a substantially horizontal use position extending from said base cabinet; and an exit port provided at an end of said at least one curved track to permit removal of said table top from said base cabinet.

2. The system of claim 1 wherein said at least one retaining pin comprises two retaining pins and said at least one curved track comprises two curved tracks.

3. The system of claim 1 further comprising a stop block adapted for selective placement into said at least one curved track to prevent removal of said table top from said at least one curved track.

4. The system of claim 1 wherein said at least one curved track further comprises a detent for holding said at least one retaining pin when said table top is in said substantially horizontal use position.

5. The system of claim 4 wherein said exit port is situated above said detent.

6. The system of claim 4 wherein said exit port is situated below said detent.

7. The system of claim 1 wherein said at least one retaining pin is removable from said table top.

8. A collapsible cabinet and table system including a base cabinet having an internal cavity and mobile cart having a table top, said system comprising:

at least one retaining pin connected to a leading edge of said table top; and at least one curved track provided in said cavity, said at least one curved track being cooperable with said at least one retaining pin to direct said table top to a substantially vertical storage position within said base cabinet and a substantially horizontal use position extending from said base cabinet, said at least one curved track having a substantially vertically directed peak defined by downwardly sloping track portions at opposite sides of said peak, whereby said table top is biased (1) toward said substantially vertical storage position when said retaining pin is situated in said at least one curved track at a portion thereof located at one side of said peak and, (2) toward said substantially horizontal use position when said retaining pin is situated in said at least one curved track at a portion thereof located at an opposite side of said peak.

9. The system of claim 8 wherein said at least one retaining pin comprises two retaining pins and said at least one curved track comprises two curved tracks.

10. The system of claim 8 further comprising a stop block adapted for selective placement into said at least one curved track to prevent removal of said table top from said at least one curved track.

11. The system of claim 8 wherein said mobile cart includes a guide block capable of insertion into an upper end of said at least one curved track.

* * * * *